US006325013B1

(12) United States Patent
Brown

(10) Patent No.: US 6,325,013 B1
(45) Date of Patent: Dec. 4, 2001

(54) PORTABLE BOAT HAVING A PLURALITY OF ATTACHABLE SEGMENTS

(76) Inventor: Michael D. Brown, 93 Briar Patch La., Sewell, NJ (US) 08080

( * ) Notice: Subject to any disclaimer, the term of this patent is extended or adjusted under 35 U.S.C. 154(b) by 0 days.

(21) Appl. No.: 09/490,101

(22) Filed: Jan. 24, 2000

(51) Int. Cl.[7] ..... B63B 7/04
(52) U.S. Cl. ..... 114/352; 114/357
(58) Field of Search ..... 114/351, 352, 114/353, 354, 355, 357

(56) References Cited

U.S. PATENT DOCUMENTS

| | | | | |
|---|---|---|---|---|
| 2,569,611 | * | 10/1951 | Jenkins | 114/352 |
| 3,744,071 | * | 7/1973 | Bossler | 114/352 |
| 4,052,761 | * | 10/1977 | Rilling | 114/352 |
| 4,366,769 | * | 1/1983 | Lingeman | 114/352 |
| 4,779,556 | * | 10/1988 | Smith | 114/352 |
| 4,827,865 | * | 5/1989 | Yelderman | 114/353 |
| 4,919,632 | * | 4/1990 | Smith et al. | 114/352 |

FOREIGN PATENT DOCUMENTS

| | | | | |
|---|---|---|---|---|
| 234296 | * | 7/1959 | (AU) | 114/352 |

* cited by examiner

*Primary Examiner*—Stephen Avila

(57) ABSTRACT

A portable boat having multiple sections, which are connected together during use and are stacked together when not use is disclosed. Each boat section is formed of an inner an outer shell each formed of molded plastic and attached in a such a manner as to preserve the buoyancy and integrity of the boat. The boat is formed of bow section, a stern section and at least one center section. The bow and stern sections of the boat are each fitted with either a hook or tab at one end for connection to a center boat section. Each center boat section has both a hook and a tab at opposite ends for connection to the bow section, the stern section or another center boat section. The boat sections are constructed such that when connected, the boat is rigid and of uniform width. Each point of attachment is characterized by three separate connecting mechanisms. This provides for a rigid and secure attachment between boat sections. Moreover, in the case of failure of one of the connecting mechanisms, it maintains the connection between the boat sections.

17 Claims, 6 Drawing Sheets

PORTABLE BOAT HAVING A PLURALITY OF ATTACHABLE SEGMENTS

BACKGROUND OF THE INVENTION

1. Field of the Invention

The present invention relates generally to portable boats and in particular to portable boats, which can be assembled from and disassembled to a plurality of separate boat segments.

2. Description of the Prior Art

Boating is traditionally an exciting and popular sport that is enjoyed by many. However, a number of people are prevented from experiencing the joys of boating due to either: (a) the need purchase a large amount of expensive equipment; and/or (b) the enormous amount of storage space required to store the boat and its associated equipment when it is not use. Moreover, boaters also need to purchase additional equipment in the form of a boat trailer, towing equipment, or roof racks to transport the boat from their home or the boat's storage location to its place of ultimate use. Therefore, there is need to develop a boat which is both easily portable and easily storable for the user and does not require a lot of additional equipment to transport the boat.

In the past, many types of portable boats have been developed. These prior art portable boats can be classified in three general categories: (i) collapsible boats; (ii) foldable boats; and (iii) sectional boats.

Collapsible boats are typically characterized by one or more sides that collapse to form a more compact package for travel. One such collapsible boat is detailed in U.S. Pat. No. 4,282,616 issued to Battershill. The collapsible boat in the '616 patent requires the individual pieces of the boat to be "laced" together using a nylon cord and the placement of rubber strips at key joints for waterproofing.

Such collapsible boats are often formed using a flexible material such as rubber or rubberized canvas, alone or in conjunction with rigid sections. Often these collapsible boats can require many individual pieces that are complicated and time consuming to assemble. Additionally, the collapsible nature of the boats makes them more susceptible to stresses and opposing forces at the junctions of the various pieces, and therefore an overall unstable structure.

The second category of portable boats, the folding boats, are often characterized in that the boat sections are hinged together to fold over on each other. One such folding boat is shown in U.S. Pat. No. 4,827,865, issued to Yelderman. This patent shows a boat that is formed of two separated sections that are pivotally connected along a top edge. When in use as a boat, a pair flanges positioned at the joining edge of one boat section provide a means for securing the bottom edges of the two boat sections together at the bottom edge as well. However, the two sections of the boat are always attached at the top edge by the hinge. Even when folded, the boat is not compact or easily transported.

Another folding boat is shown in U.S. Pat. No. 5,183,002, issued to Parker. This patent discloses a folding boat, which comes apart in multiple sections that further fold along a centerline. The sections nest inside one another to form a more compact unit for storage. However, the boat does not provide for multiple points of connection between the sections to provide for a secure vessel.

Some of the disadvantages of the collapsible boats and the folding boats have been overcome by sectional or segmented boats. Typically, sectional boats have multiple rigid segments that can be completely separated for ease of handling and portability. Many such boats have sections that nest inside each other for easy storage.

One such nesting boat is shown in U.S. Pat. No. 4,574,725, issued to Dowd. In the '725 patent, the individual boat sections are formed so that they are identical in structure but vary in size for easy nesting. When assembled, the boat has an irregular shape, wherein it angles outward from a narrow point at one end to wide point at the opposite end. This design makes for an awkward boat shape that is entirely restricted by the dimensions of the largest section.

Another nesting sectional boat is shown in U.S. Pat. No. 4,522,145, which is of a more regular shape. However, the sections of the boat in the '145 patent are relatively large and when nested do not form a compact package.

Another point of weakness with prior art sectional boats is the mechanisms used to attach the segments to each other. The sectional boats of the prior art have provided for a variety attachment mechanisms to connect the plurality of sections to form a rigid boat structure. U.S. Pat. Nos. 5,261,346 and 3,822,427 each provide for the individual boat sections to be joined by tongue and groove type of flanges positioned vertically along mating surfaces of the boats. The boat described in the '346 patent also uses a specially designed U-shaped clamp to further secure the sections together. While the boat detailed in the '427 patent uses a number of bolts and screws to further secure the sections together.

The tongue and grove or dovetail joints of these boats must be precision manufactured to provide for accurate mating between the sections of the boats. This type of precision manufacturing can often substantially increase the cost of manufacture and the likelihood of producing parts that are unacceptable.

In U.S. Pat. No. 4,522,145, issued to Stone, there is shown a sectional boat in which the sections are joined by means of transverse clamping mechanism, another specially manufactured part. The sectional boats of the prior art have generally provided for complex means of connection between the segments that often require multiple parts, the use of additional tools for assembly, as well as special or precision manufacturing techniques to produce the boat sections.

Therefore, there is a need in the field of portable, sectional boats for a boat which has a regular outer shape for good boat performance, but wherein the sections of the boat will nest inside each other for compact storage and easy portability. There is also a need for a sectional boat which can be easily manufactured and assembled by the user without the use of complicated attachment mechanisms or additional tools. There is a further need for a sectional boat that has multiple points of attachment between each of the segments to provide for a secure rigid boat structure.

OBJECTS OF THE INVENTION

It is an object of the present invention to provide for a rigid sectional boat which can be easily manufactured.

It is a further object of the invention to provide for a rigid sectional boat wherein each of the boat sections is formed of two separate layers of rigid plastic.

It is a further object of this invention to provide for a rigid sectional boat wherein, when disassembled, the segments of the boat nest inside each other for easy compact storage.

It is a further object of this invention to provide for a rigid sectional boat wherein, when disassembled, the segments of the boat nest inside each other for easy portability from place of storage to place of ultimate use.

It is another object of this invention to provide for a rigid sectional boat wherein the boat segments can be easily assembled and disassembled without the use of tools.

It is yet another object of this invention to provide for a rigid sectional boat which when assembled has a regular external shape that moves easily through the water.

It is yet another object of this invention to provide for a portable boat formed of a plurality of different connectable segments.

It is still another object of this invention to provide a portable boat formed of multiple segments which connected to each other by multiple points of attachment to form a safe and secure water craft.

It is still yet another object of this invention to provide a portable boat which can be disassembled to a compact package which can hold all of the equipment for an outing.

SUMMARY OF THE PRESENT INVENTION

In general, the portable, sectional boat of the present invention, provides a simple, secure yet low cost solution to the problems described in the Background of the Invention. This is achieved by strategically employing a plurality of attachment points which utilize technically simple connection mechanisms between different the sections of the boat. These different points of attachment cooperate to form a boat that is rigid when assembled and secure when in use.

The portable boat of the present also employs design features which allow the boat to be easily manufactured to produce a boat that has independently buoyant segments that connect together to form a rigid boat of regular construction that will glide easily through the water, yet will disassemble to several differently sized segments that nest for easy storage and portability.

Therefore, the portable boat of the present invention includes a plurality of boat sections, including a bow section, a stern section, and at least a one passenger section. Each section of the boat is formed of an inner shell and an outer shell connected together with a watertight seal. The bow section has a bottom, a back wall portion, and side-wall portions. The stern section has a bottom, a front wall portion, side portions and a rear stern wall. The passenger section has a bottom, a front wall portion, a back wall portion, and side-wall portions. Each of the front walls has a hook member formed along its top edge. Each of the back wall portions has a tab member formed along its top edge.

When the bow, stern and passenger sections of the boat are connected together, each hook member engages a corresponding tab member when the front wall portion of one boat section is positioned adjacent the back wall portion of a second boat section. At least one pair of removable fastening means further secures the plurality of boat sections to each other at a plurality of different points, such that when the hook member and the tab member are engaged and the pair of removable fastening members are secured, the plurality of boat sections are rigidly connected to each other to form a complete boat.

BRIEF DESCRIPTION OF THE DRAWINGS

For a fuller understanding of the Objects of the Present Invention, the Detailed Description of the Illustrative Embodiment will be taken in connection with the accompanying Drawings, wherein.

DETAILED DESCRIPTION OF THE DRAWINGS

For purposes of illustration, the present invention will be described below with reference to the accompanying Drawings, with like structures being indicated by like reference numbers.

Figure 1:
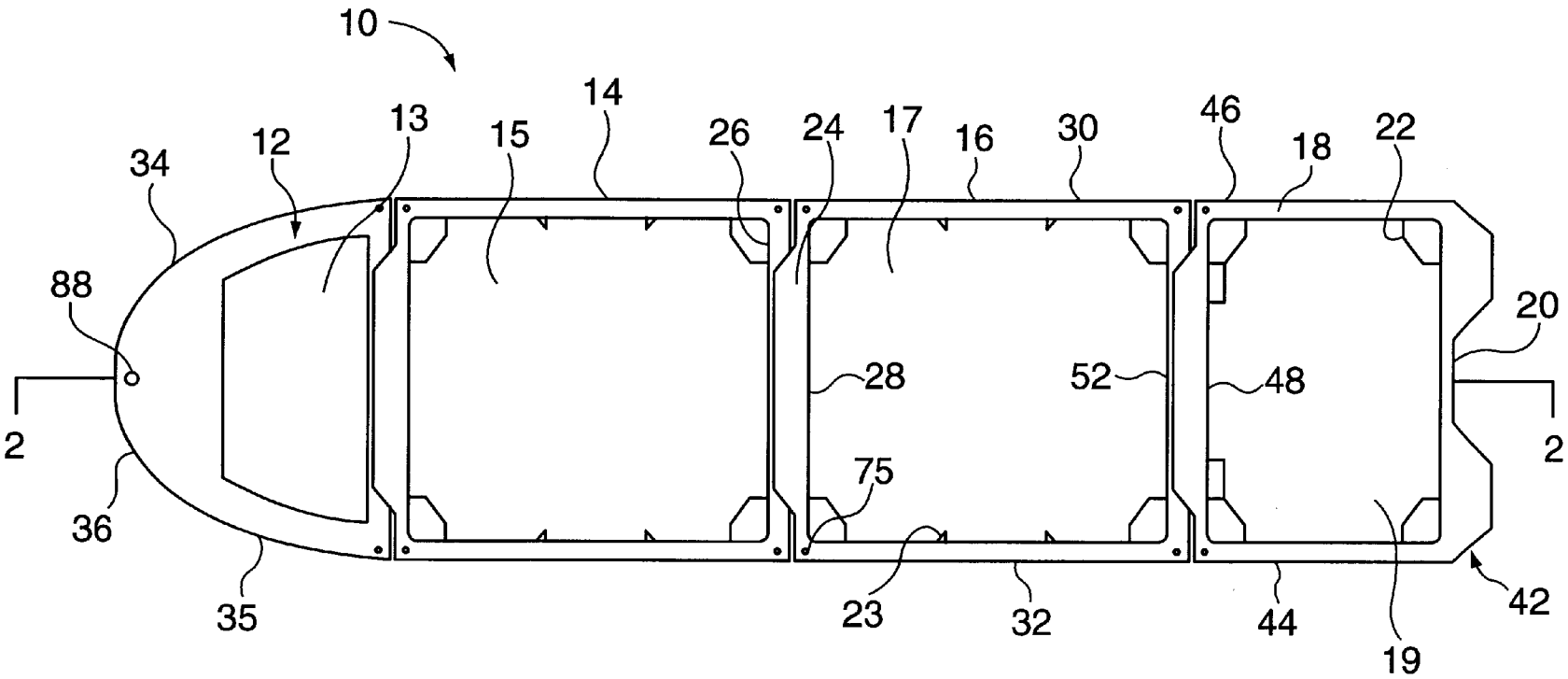
FIG. 1 is top perspective view of a portable sectional boat constructed in accordance with the principles of the present invention.
Figure 2:
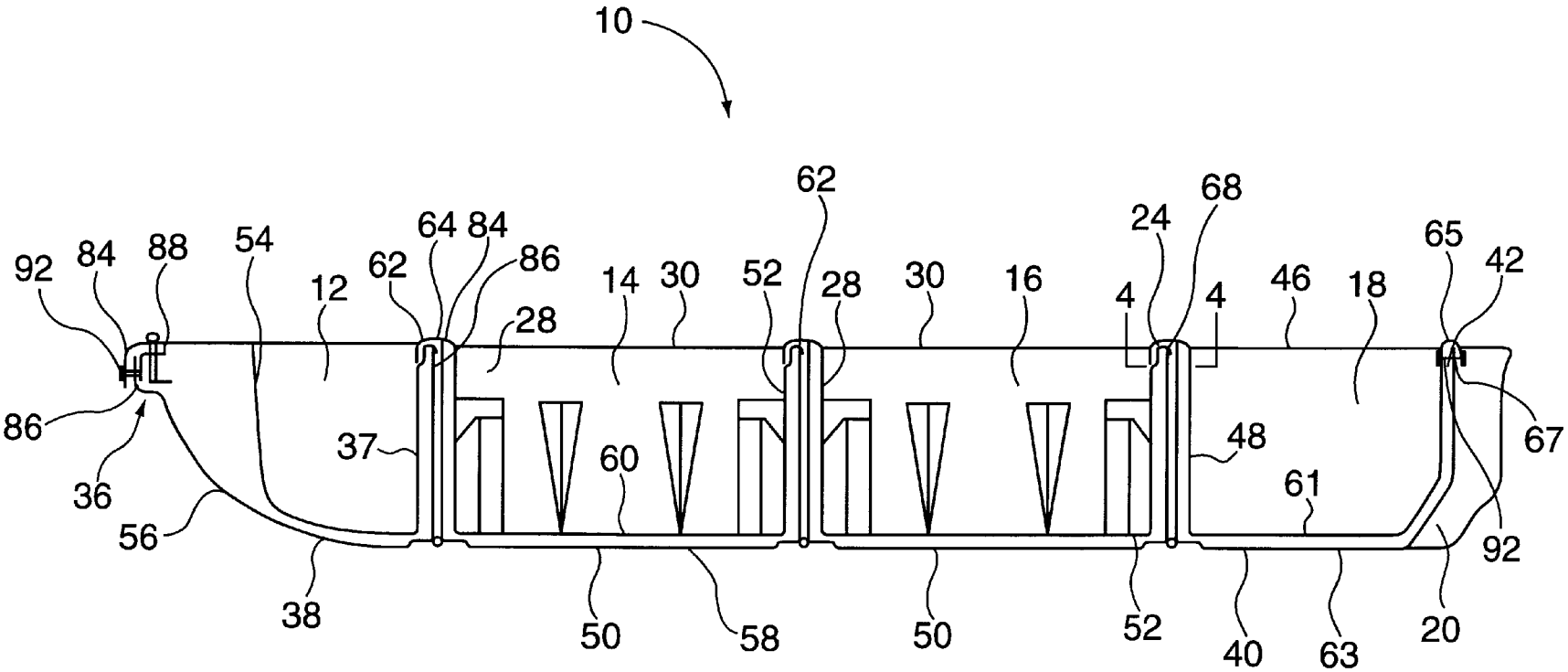
FIG. 2 is a cross-sectional elevated side view along the longitudinal extent of the portable sectional boat of FIG. 1 showing the internal construction of the illustrative embodiment.

As shown in FIGS. 1 and 2, the portable sectional boat 10 of the present invention is formed of a plurality of different boat segments or sections. There is a front or bow section 12. The bow section 12 is characterized by a pair of side-wall sections 35 and 34 which meet at the front of the boat to form a rounded bow front edge 36. The rounded bow front edge 36 provides for the typical bow shape associated with a boat and allows for easy movement through the water. In addition to the side-wall sections 34 and 35, the bow section 12 also has a bottom 38 and an open center 13.

The portable boat 10 also has a rear segment or stern section 18. The stern section 18 has a bottom 40, a front wall portion 48, two side-wall portions 44 and 46, and a rear stern wall 42. The rear stern wall 42 has a notch 20 formed therein for receiving an outboard motor (not shown). Additionally the stern section 18 has an open center 19. The stern section will be described in more detail hereinafter.

In the preferred embodiment there is at least one passenger compartment or section for a one-man boat, and at least two passenger compartments or sections for a two-man boat. The embodiment shown in FIGS. 1 and 2 includes two passenger sections 14 and 16. However, by removing one of the passenger sections 16 or 14 from the portable boat 10, the boat can be easily converted into a one-man boat. Therefore a one-man boat having only one passenger section 14 or 16 is also within the scope of this invention.

Each passenger section 14 and 16 is identical to the other passenger section and has a bottom 50, a front wall portion 28, a back wall portion 52, right and left sidewall portions 30 and 32, respectively, and an open center 15 or 17, respectively.

Each of the plurality of boat sections 12, 14, 16 and 18 are formed of an inner shell and an outer shell. FIG. 2, which is a cross-sectional view through the boat 10 along line 2—2 of FIG. 1, clearly shows the inner shell and outer shell for each compartment or boat section.

The bow section 12 is formed of inner shell 54 and outer shell 56. The inner shell 54 and outer shell 56 are each manufactured as a vacuum-formed molded plastic part that is complementary to the other shell. Methods other than vacuum-formation could be employed such as injection molding or roto-molding without going beyond the scope of the invention. The inner shell 54 fits easily into the outer shell 56. The inner shell 54 has a lip portion 84 which fits over and around the top edge 86 of the corresponding outer shell 56. As shown in FIG. 2, the bow section 12 further employs bracket 88 along the interior of edge 36 to provide further support and means for attaching the inner shell 54 to the outer shell 56. The inner shell 54 and outer shell 56 are also fixedly attached to each other along the lip portion 84 and the top edge 86 by a series of rivets 92 which pass through both the inner shell 54 and the outer shell 56.

Each rivet 92 has a flat head forming a water-tight seal between the two layers to maintain the integrity, seaworthiness, and buoyancy of each individual boat section or segment. The rivets 92 could easily be replaced other fastening mechanisms, such as bolts, screws, watertight glue or welds, and still be within the scope of the invention.

Figure 5:
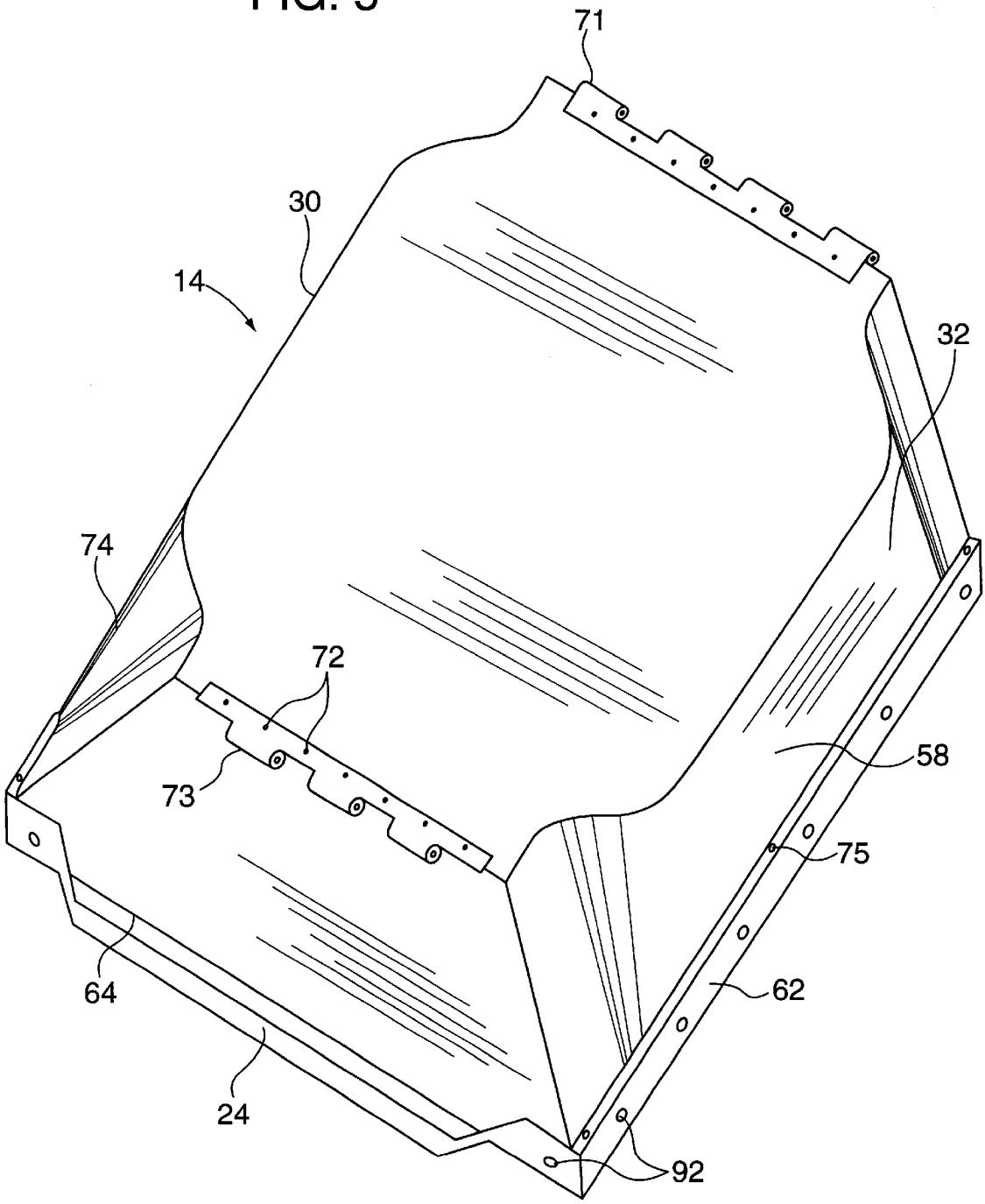
FIG. 5 is a perspective view of the bottom of a center boat section showing the continuous hinge joint for connecting the boat sections.

Each individual boat compartment or section 12, 14, 16 and 18, is characterized by this same two-layer construction of an inner shell and an outer shell. As shown in more detail in FIG. 3, each passenger compartment 14 and 16 has an inner shell 60 and an outer shell 58. The inner shell 60 for each passenger compartment has an outer lip portion 62 that overlaps the top edge 64 of the outer shell 58. As shown in FIG. 5, the inner shell 60 and outer shell 58 of the passenger compartments 14 and 16 are fixedly attached to each other by a series of rivets 92 that are positioned along the outer edge of the boat side-walls 30 and 32 through the outer lip portion 62 and the top edge 64 of the outer shell 58.

Again, both the inner shell 60 and the outer shell 58 of the passenger compartments are formed of molded plastic such that they complement each other and fit together easily. The inner shell 60 slides inside of outer shell 58 such that the outer lip portion 62 fits over and down approximately two to three inches along the top edge 64 of outer shell 58. The snug fit between the inner and outer shells of each compartment or boat section provides for ease in manufacture and assembly of the finished product. It also provides for a strong, rigid boat compartment that is independently buoyant.

The two-layer construction of the boat also allows the boat to be more easily manufactured and mass-produced through precision injection molding techniques. The inner shell and the outer shell can be precision molded separately and then assembled into the complete boat section. Additional materials, such as Styrofoam and the like can be inserted or injected in between the outer and inner shells to provide for additional stability. Furthermore, pontoons can be added to the outer sides of the passenger compartments to provide for additional weight capacity and increased stability.

Inside of each of the passenger compartments 14 and 16 are located a plurality of seat brackets 22 and 23 for supporting a removable seat (not shown). The seat brackets 22 and 23 are located at both ends of the passenger compartments 14 and 16 to allow for a variety of seating positions for the passenger. In use, the seat would rest on top of the seat brackets 22 and 23. Additionally, a fastener could be provide to lock the seat into place to prevent its loss in the event the boat is tipped over during use.

The stern section 18 or rear segment of the portable boat 10 is constructed similarly to the bow section 12 and passenger sections 14 and 16. The stern section 18 has a bottom 40, a back wall portion 42, and two side-wall portions 46 and 44. The stern section 18 also has a front wall portion 48. The back wall portion 42 of the stern section 18 has formed therein a notch 20 for receiving a boat motor. This notch 20 allows the user of the portable boat 10 to easily convert from man-power employing paddles or oars (not shown) to mechanized-power employing a boat motor (not shown). The boat motor fits easily into notch 20 at the back of stern section 18.

Similar to the bow section 12 and passenger sections 16 and 18, the stern section is made of a dual layer construction. There is an inner shell 61 that has an outer lip portion 65 that fits over the top edge 67 of outer shell 63. The inner shell 61 and outer shell 63 are fixedly attached in the same manner as each of the other boat segments using a series of rivets 92 which pass through the extended portion of the outer lip portion 65 and through the top edge 67 of inner shell 61.

Figure 6:
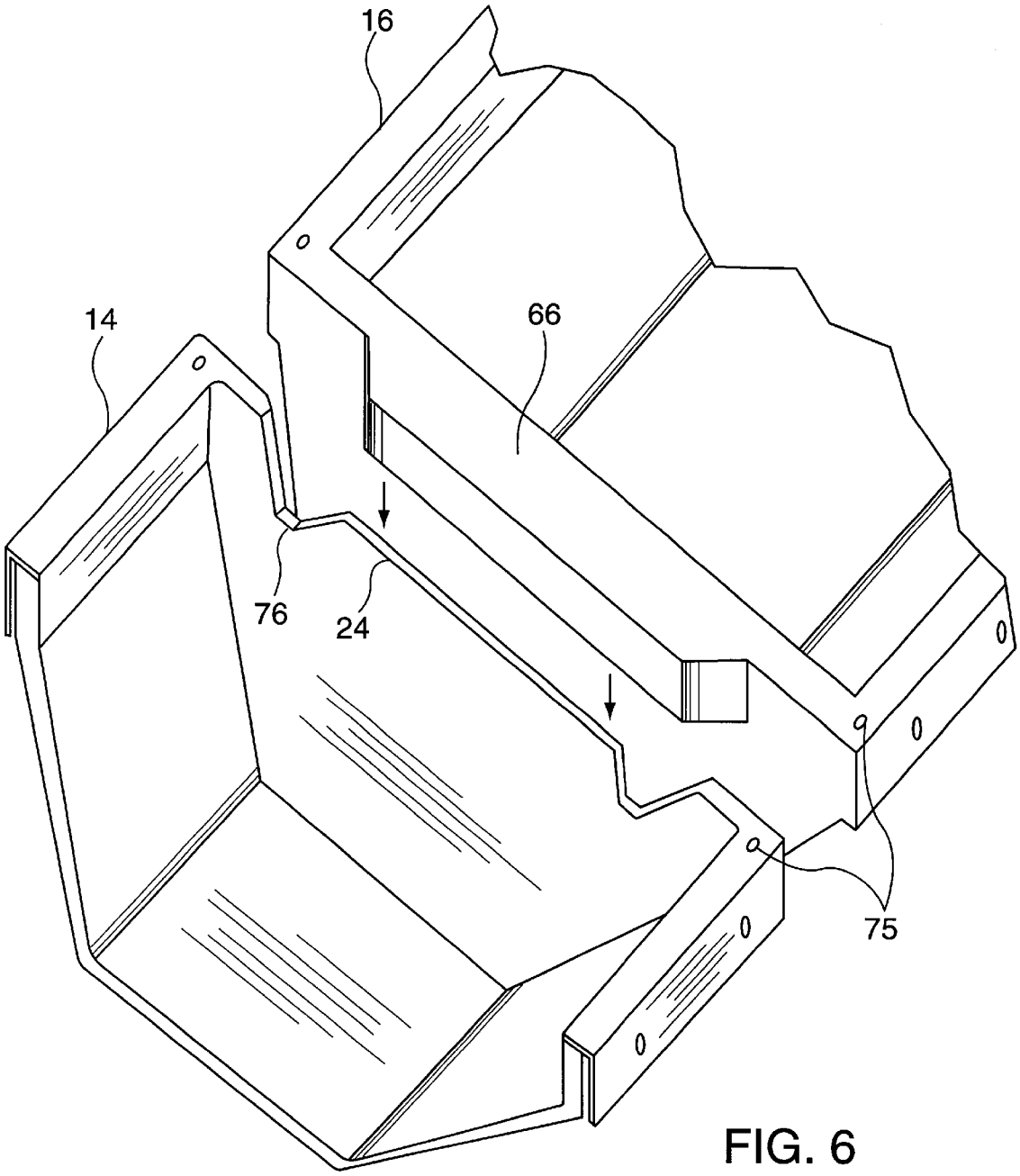
FIG. 6 is a perspective view illustrating how the hook portion of a first boat section fits onto the tab section of a second boat section.

The section of each outer lip portion 62 and 65 which extends along the front wall portions 48 and 28 of the stern section 18 and each of the passenger sections 14 and 16, respectively, is extended outwardly to form a hook member 24. The section of each outer lip portion 62 and 65 which extends along the back wall portions 37 and 52 of the bow section 12 and each passenger section 14 and 16, respectively, is indented somewhat to form a tab member 68 along the top edge of each back wall portion 37 and 52. As shown in FIGS. 1, 2, 3, 5 and 6, each hook member 24 will engage a corresponding tab member 68 when each front wall portion 48 or 28 is positioned adjacent its corresponding back wall portion 52 or 37. Each tab member 24 can be further delineated from the back wall portion 52 or 37 by a pair of notches 76 positioned at each end of tab member 24 towards the side-wall portions. FIG. 6 shows how the hook portion 66 fits over the tab member 24 when the boat sections are placed next to each other.

Figure 4:
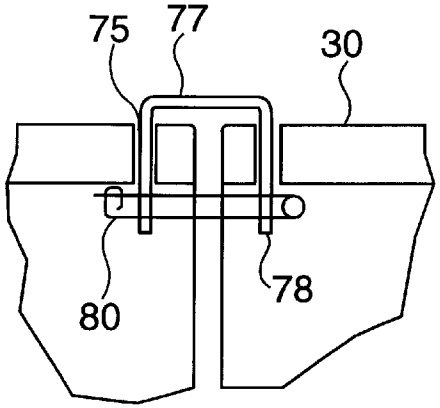
FIG. 4 is an exploded view of the u-clasp locking mechanism for the boat sections.

In addition to the hook and tab connection between boat sections, a pair of removable u-shaped clips 77 are used to fasten the boat sections together. FIG. 4 illustrates how each u-shaped clip is inserted into bores 75 formed at the side corners of each boat section. Each bore 75 is formed through the top outer edge of each boat segment at the corners of each front wall portion and each side-wall portion. Each bore 75 is lined with metal or plastic such that the water-resistant seal between the inner and out shell of each boat section is maintained.

The ends 78 of each u-shaped clip 77 are fitted with a clasp member 80. U-shaped clip 77 is inserted through bore 75. Clasp member 80 fits through apertures formed in clip ends 78. The u-shaped clip 77 provides a mechanism for further securing the plurality of boat sections to each other. When the hook member 66 and the tab member 24 are engaged and the pair of u-shaped clips are secured, the plurality of boat sections are rigidly connected to each other to form a complete boat. The use of a u-shaped clip in the preferred embodiment as shown and described herein is merely illustrative. The u-shaped clip could easily be replaced with another fastener such as a clasp, a bolt, a clamp, a screw, or other such latching mechanism and still be within the scope of the invention.

Figure 3:
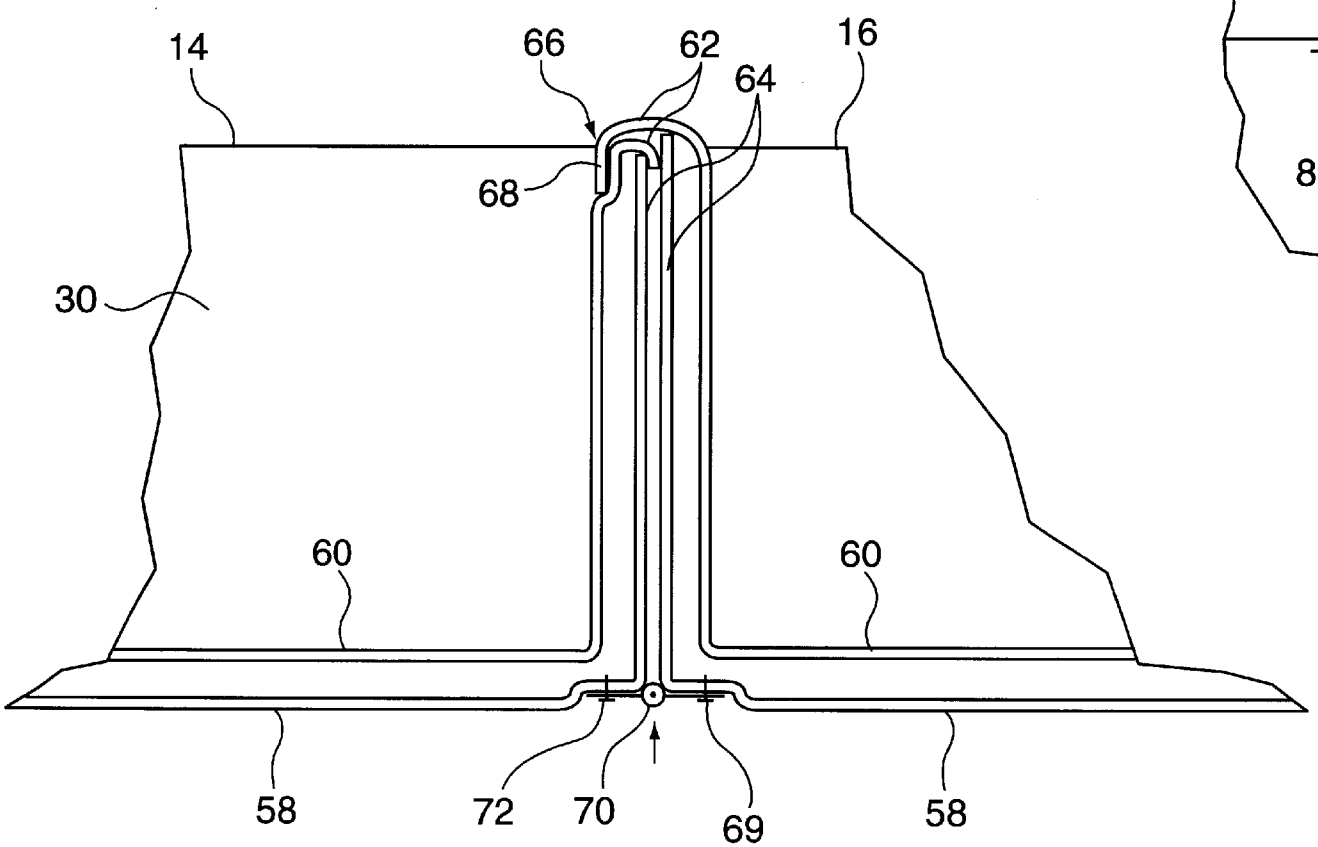
FIG. 3 is an exploded view of the tab and hook connection between boat sections.

A third mechanism is also employed to further lock each of the boat sections together in a rigid manner. One half of a continuous hinge 69 is fixedly attached to the bottom edge of each front wall portion 28 and 48 and each back wall portion 37 and 52 such that when the front wall portion 28 or 48 of one boat section is brought into contact with the back wall portion 37 or 52 of another boat section, each half 71 of the continuous hinge is mated with its corresponding other half 73 to form a complete hinge 69. Once mated the halves 71 and 73 of the continuous hinge 69 are secured by hinge pin 70, as shown in FIG. 3. Each half 71 and 73 of the continuous hinge 69 is secured to the bottom edge of each boat section with screws or bolts 72.

To assemble the complete boat as shown in FIGS. 1 and 2, the boat user would align each of the individual boat segments or compartments as follows: (a) first the bow section 12 is set on the ground along its side-wall portion 34 or 35 with the bottom 38 facing outwardly so that hinge-half 71 is exposed; (b) take the first passenger compartment 14 and align it with bow section 12 so that its back wall portion 37 is facing the front wall portion 28 of passenger compartment 14; (c) insert the tab member 68 of back wall portion 37 of bow section 12 into hook member 24 of front wall portion 28 of passenger compartment 14; (d) insert u-shaped clip 77 into the pair of corresponding bores 75 in bow section 12 and passenger compartment 14 such that the u-shaped clip 77 bridges both boat sections; (e) insert clasp 80 through apertures 78 in u-shaped clip 77 and secure; (f) insert hinge pin 70 through the center of continuous hinge 69 along the bottom edges of the boat sections; (g) turn boat over so that the other side-wall portion is exposed; (h) insert second u-shaped clip 77 into the pair of corresponding bores 75 in bow section 12 and passenger compartment 14 such that the u-clip 77 bridges both boat sections; (i) insert clasp 80 through apertures 78 in u-shaped clip 77 and secure; (j) repeat steps (a) though (i) until boat is fully assembled adding one boat section at a time and finishing with the stern section 18.

Alternatively, the boat could be assembled with the bottom placed directly on the ground such that the bow section 12 is placed first, then the hook member 24 of first passenger compartment 14 is placed over the tab portion 66 of bow section 12. Next, the second passenger compartment 16 is placed adjacent the first passenger compartment 14 such that the hook member 24 of the second passenger compartment 16 is placed over the tab portion 66 of the first passenger compartment 14. Finally, the front wall portion 48 of stern section 18 is aligned with the back wall portion 52 of the second passenger compartment 16 such the hook member 24 of the stern section 18 engages the tab member 66 of second passenger compartment 16.

When all of the boat sections are aligned and the hook members and tab portions are engaged, the u-shaped clips 77 are inserted at each boat section junction (the point where two boat section meet) through lined bores 75. As each u-shaped clip 77 is inserted, clasp 80 is secured through apertures 78. After each u-shaped clip 77 has been installed and secured, the entire boat can be tilted up on one side to reveal the boat bottom and continuous hinge 69. Next, each hinge pin 70 should be inserted into its respective continuous hinge 69 to further secure the boat sections together.

The combination of the hook/tab engagement, the clip mechanism 77, and the continuous hinge 69 form a comprehensive system for securing the segments or sections of the portable boat to each other to form a single rigid watercraft. The use plural attachment points provides a unique means to increase the integrity and strength of the resulting watercraft. Moreover, each of the individual boat sections or segments is of the same width such that the resulting boat is of regular construction and provides ample room for one to two passengers.

In use, the passenger seats (not shown) are installed and one passenger is seated in each compartment. The boat can be moved through the water with paddles, oars or a small motor.

As can be seen from the detailed description of the assembly procedure the entire boat can be assembled by the user on site without the use of any tools or special equipment. The tab and hook members are integral to the boat's structure. The u-shaped clips are specially designed for easy insertion and engagement. The bottom hinge requires only alignment of the boat sections and insertion of the hinge pin. Each of these actions can be completed in minutes by a user with no tools.

The boat can be disassembled in the same manner as described above, by reversing the procedure detailed above. First, each hinge pin 70 is removed from each continuous hinge 69. Then each u-shaped clip 77 is removed from the bores 75 by first releasing the clasp 80. Then each tab member 24 is disengaged from each hook portion 66 and the boat sections are separated.

Figure 7:
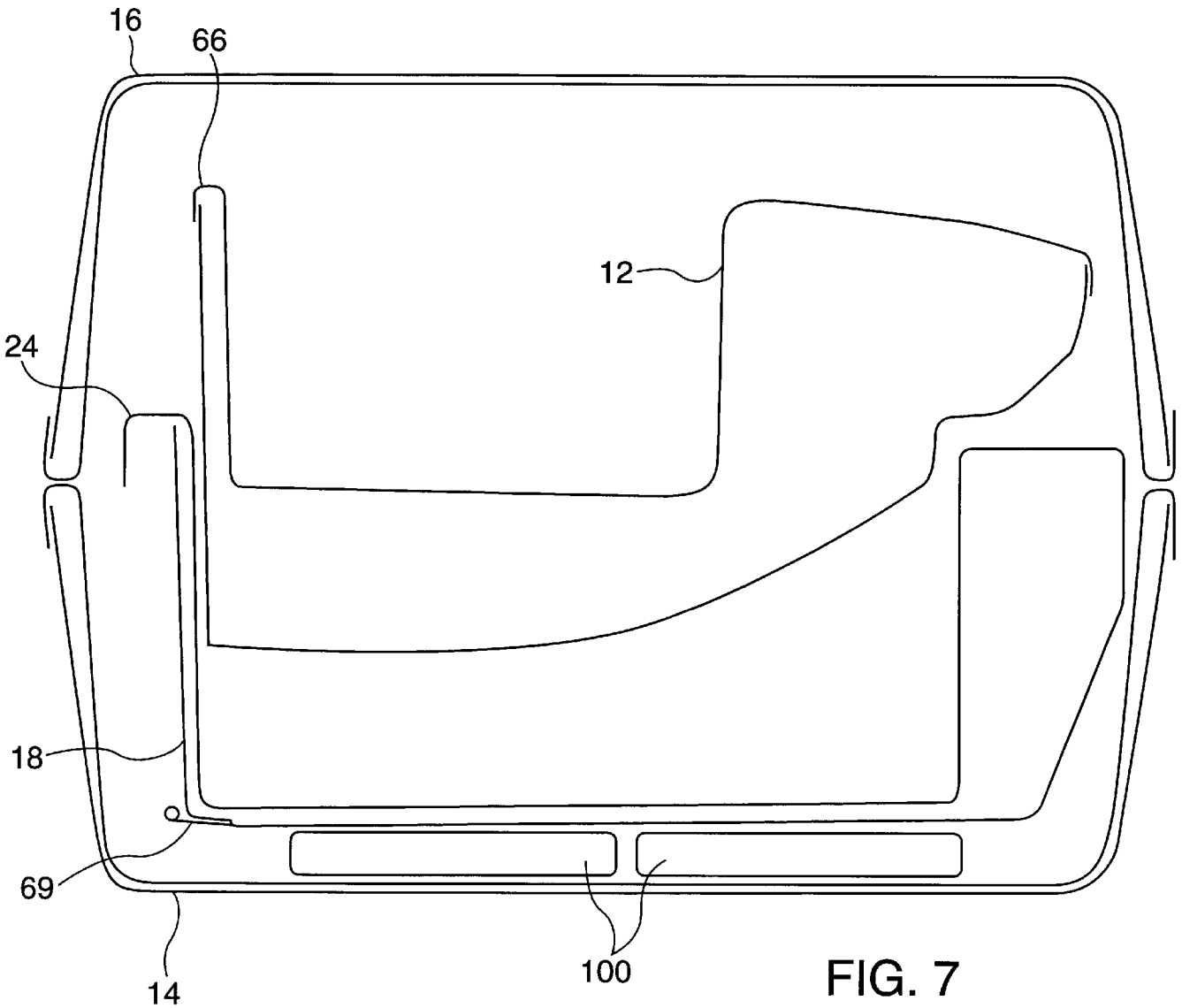
FIG. 7 is a cross sectional view showing how the different boat sections stack together to form a compact unit for storage and transport.

For storage, and transportation from place of storage to the place of ultimate use, be it a river, or lake, or other body of water, the boat sections nest inside each other as shown more clearly in FIG. 7. The nested boat sections are shown in cross-section such that how they easily fit together for storage may be more easily viewed. First, one of the passenger sections 14 or 16 should be placed on a flat surface with its center opening 15 or 17 facing upward. This section will form the bottom of the compact package that is produced when the boat sections are nested together. Next, the stern section 18 is placed inside of the passenger compartment with its opening facing the inside bottom of the passenger compartment 16. Then the bow section 12 is placed over the stern section 18, again with its opening facing the bottom 38 of the stem section 18. Floatation devices such as seat cushions, important for boat safety, can be placed on top of the stem section 18 to act as a bumper or filler to prevent jarring of the boat sections during transport. Finally, the second passenger section 14 fits over the seat cushions 100 and the stern section 18, with its opening facing downward such that the top edges of the side-wall portions 30 and 32 of both passenger sections 14 and 16 meet. Once the boat sections have been arranged as described above the package can be secured by placing pins through bores 75 at the four corners of the now-stacked passenger compartments 14 and 18. The entire boat can now be secured using adjustable straps, ropes, bungee cords, or other appropriate tying or fastening mechanism (not shown).

This provides for a compact package that can be easily stored in a closet, garage, or basement. What allows the boat sections to nest so easily is that the bow section 12 and the stern section 18 are shorter in length than the passenger sections 14 and 16. However, both the stern section 18 and the bow section 12 are of the same width as the passenger sections 14 and 16, so that when the boat is completely assembled, its regular in shape and provides for easy flow through the water.

Additionally, pontoons can be attached to the outside edges of the fully assembled boat to increase the weight capacity and buoyancy of the boat during use. The pontoons can be attached to the boat by any of the means discussed hereinabove. Moreover, several of the assembled boats can be configured and connected together so that they form such boat styles as a catamaran or a trimaran.

While the particular illustrative embodiments shown and described above will be useful in many applications for producing a portable sectional boat, further modification to the present invention herein disclosed will occur to persons skilled in the art. All such modifications are deemed to be within the scope and spirit of the present invention defined by the appended claims.

What is claimed is:

1. A rigid sectional boat comprising:

a plurality of boat sections, including a bow section, a stern section, and at least a first passenger section, each section being formed of an inner shell and an outer shell;

said bow section having a bottom, a back wall portion, and side-wall portions;

said stern section having a bottom, a front portion, a back wall portion and side-wall portions;

said passenger section having a bottom, a front wall portion, a back wall portion, and side-wall portions;

each said front wall portion having a hook member integrally formed along a top edge of said front wall portion;

each said back wall portion having a tab member integrally formed along a top edge of each said back wall portion;

wherein said hook member engages said tab member when said front wall portion and said back wall portion are positioned adjacent;

continuous hinge mechanisms for attaching said plurality of sections to each other along a bottom edge thereof; and a pair of removable fastening means for further securing said plurality of boat sections to each other as a plurality of different points whereby when said hook member and said tab member are engaged, said continuous hinge mechanisms are employed, and said pair of removable fastening members are secured, said plurality of boat sections are rigidly connected to each other to form a complete boat.

2. The sectional boat of claim 1, wherein said inner shell and said outer shell are both comprised of molded plastic pieces that are fixedly coupled to form said plurality of boat sections.

3. The sectional boat of claim 2, wherein said molded plastic pieces which form said inner and outer shells are further characterized in that said inner shell is molded to closely fit inside of said outer shell to form a rigid two-layer structure.

4. The section boat of claim 2, wherein said inner shell of said first passenger section has a plurality of support members integrally formed along each side-wall portion.

5. The sectional boat of claim 1, wherein said plurality of boat sections are independently buoyant.

6. The sectional boat of claim 1 wherein said plurality of boat sections includes a second passenger section.

7. The sectional boat of claim 6 wherein said first and second passenger sections are identical.

8. The sectional boat of claim 7 wherein said identical first and second passenger sections form a compact container for storing said bow section and said stern section during storage or transportation of said sectional boat.

9. The sectional boat of claim 7 wherein said bow section and said stern section nest inside of said first and second passenger sections during storage or transportation of said sectional boat.

10. The sectional boat of claim 6, wherein both said first and second passenger sections further include integrally formed seat support structures for supporting a removable passenger seat.

11. The sectional boat of claim 1, wherein said passenger section further includes integrally formed seat support structures for supporting a removable passenger seat.

12. The sectional boat of claim 1, wherein said removable fastening means is a u-shaped clip member.

13. The sectional boat of claim 1, further comprising a pair of pontoons attached to the other edges of said boat to provide additional weight capacity for said boat.

14. A method for assembling a rigid sectional boat comprising:

aligning a plurality of boat segments, including a front segment, a rear segment, and at least one center segment, wherein said front section has a back wall portion, and a pair of side-wall portions, said rear segment has a front wall portion, a pair of side-wall portions and a rear notched wall portion, and said center segment has a front wall portion, a back wall portion, and a pair of side-wall portions;

positioning a hook member formed along a top edge of each front wall portion over a tab member formed along a top edge of each back wall portions, engaging said tab member within said hook member;

inserting a pair of removable fastening means through apertures formed through each of the corners of each said front wall portion and each said back wall portion; and attaching said plurality of boat segments along a bottom edge of each said front wall portion and said back wall portion, such that said plurality of boat segments are rigidly connected to each other to form a complete boat.

15. The method of assembling a rigid sectional boat as set forth in claim 14, wherein said steps of engaging said tab member, inserting said removable fastening means and attaching said bottom edges of said front and back wall portions can be completed without the use of tools.

16. A rigid section boat comprising:

a plurality of boat sections, including a bow section, a stern section, and at least a first passenger section, each section being formed of an inner shell and an outer shell;

said bow section having a bottom, a back wall portion, and side-wall portions;

said stem section having a bottom, a front portion, a back wall portion and side-wall portions;

said passenger section having a bottom, a front wall portion, a back wall portion, and side wall portions;

a plurality of different mechanisms for rigidly connecting said plurality of boat sections to form a complete boat, including (i) integrally formed hook members along each said front wall portion and integrally formed tab members along each said front and back wall portions; (ii) a plurality of u-shaped clips inserted through apertures formed at the corners of said front and back wall portions; and (iii) a plurality of continuous hinge mechanisms for attaching said plurality of sections along a bottom edge thereof.

17.The rigid sectional boat of claim 16, wherein a plurality of said sectional boats can be combined to form a catamaran.

* * * * *